United States Patent [19]

Wörz

[11] 4,198,943

[45] Apr. 22, 1980

[54] COMPOSITE ELECTRONIC IGNITION SYSTEM STRUCTURE

[75] Inventor: Paul Wörz, Schwieberdingen, Fed. Rep. of Germany

[73] Assignee: Robert Bosch GmbH, Stuttgart, Fed. Rep. of Germany

[21] Appl. No.: 895,768

[22] Filed: Apr. 12, 1978

[30] Foreign Application Priority Data

May 5, 1977 [DE] Fed. Rep. of Germany ..... 2720065

[51] Int. Cl.[2] ..... F02B 77/00

[52] U.S. Cl. ..... 123/148 D; 123/148 E

[58] Field of Search ..... 123/148 R, 148 D, 148 E, 123/198 E

[56] References Cited

U.S. PATENT DOCUMENTS

| | | | |
|---|---|---|---|
| 2,462,491 | 2/1949 | Hallett | 123/148 D |
| 3,260,299 | 7/1966 | Lister | 123/148 E |
| 3,395,684 | 8/1968 | Minks | 123/148 D |
| 3,902,471 | 9/1975 | Brungsberg | 123/148 E |

FOREIGN PATENT DOCUMENTS 1803495 7/1970 Fed. Rep. of Germany .

*Primary Examiner*—Tony Argenbright

*Attorney, Agent, or Firm*—Frishauf, Holtz, Goodman & Woodward

[57] ABSTRACT

To provide for an extended heat dissipating surface to an ignition coil, the coil is combined in a single housing structure with electronic control components, and located in a well or trough or tub-like housing structure, surrounded by a resin potting compound, but separated from the housing structure which, preferably, is a metal pressure or investment casting by a cushioning layer to provide for compensation of shrinkage, or expansion, upon differential changes between the housing and the coil due to heating, the extended housing structure also enclosing electronic circuit structures such as power components and printed circuit boards to thereby permit electrical association of the components with the ignition coil while, simultaneously, providing for a larger housing structure with increased heat dissipation capability.

8 Claims, 2 Drawing Figures

COMPOSITE ELECTRONIC IGNITION SYSTEM STRUCTURE

Figure 1:
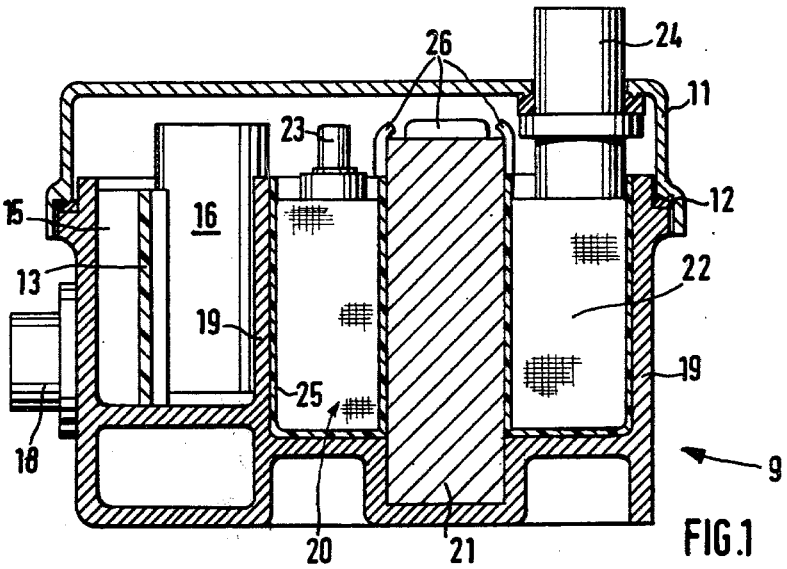

The present invention relates to an electronic ignition system structure for use with internal combustion engines, and particularly for use with automotive-type internal combustion engines, and especially to a composite structure including both an ignition coil and a control system to control current flow therethrough.

BACKGROUND AND PRIOR ART

It has been customary to arrange ignition coils in various locations on automotive vehicles, or adjacent to engines therefor, and position separate control systems, located in housings for the control components therein. The ignition coils themselves are located in fixed housings, cast therein for example, or in separate housing structures. They are customarily made as separate components positioned within the engine compartment of a vehicle, or secured to the engine, or a component thereof. When located within the engine compartment of the vehicle, they are frequently secured or attached to the fire wall of the vehicle or to one of the wheel housings. It has also been proposed to secure an ignition coil to the distributor, in which the coil housing is located either on the cap of the distributor or on the distributor housing. The ignition coil, or its housing structure, may be unitary with the ignition coil element itself.

Ignition coils, particularly of higher performance type which have a fair primary current flowing therethrough, can get hot due to the copper losses within the coil. Some cooling of the coil is, therefore, desirable, either by the housing structure itself or by the location of the coil in the engine compartment of the vehicle.

THE INVENTION

It is an object to provide an arrangement in which the ignition coil can be so positioned that heat generated due to copper losses can be efficiently dissipated and which, further, is so arranged that it can be easily mounted in the engine compartment of an automotive vehicle while being electrically associated with control components.

Briefly, a unitary housing is provided defined by a wall structure. The housing is subdivided, one portion of the housing retaining circuit elements, for example a printed circuit board on which electronic circuit components are secured to control current flow through the ignition coil. The other portion of the housing retains the ignition coil itself. The housing structure, preferably, is made of metal as a pressure or investment casting unit, so that heat generated due to current flow in the control section and in the coil can be readily dissipated by conduction and convection to the housing structure and radiation thereby.

In accordance with a feature of the invention, insulating casting compounds such as casting resins are used to secure the ignition coil within the housing and to provide for heat transfer. To prevent fissures upon possible differential expansion and contraction, as the heating of the housing and of the coil changes, it is desirable to coat all metal parts with which the casting compound comes in contact by a compensating substance which functions as a cushion. This substance may, additionally, function as a separating element so that the casting compound will not adhere thereto. The core of the ignition coil can be located within the housing by clamping it therein, for example by initially providing projecting tabs, projecting from the housing or the coil, respectively, and after assembly being bent over to hold the core securely within the housing. This permits a simple and rapid manufacture and assembly, provides for good transfer of heat arising in operation, and reliable attachment of the coil in the housing.

Arranging the ignition coil within the same housing as the circuit structure, and all within an overall retainer or housing which, preferably, is of metal, has the advantage that heat due to copper losses arising in the ignition coil can be readily dissipated, since a housing structure retaining both the ignition coil and additional circuit components will, necessarily, have a greater surface than a housing for the ignition coil alone. Thus, a substantially larger dissipating surface is available for the heat to be dissipated which, principally, arises due to operation of the ignition coil, while additionally avoiding attaching two separate structures the electronic circuit components within a housing therefor and the coil-to the vehicle, coupled with the additional labor and material requirements in interconnecting the circuits and the coil.

Figure 2:
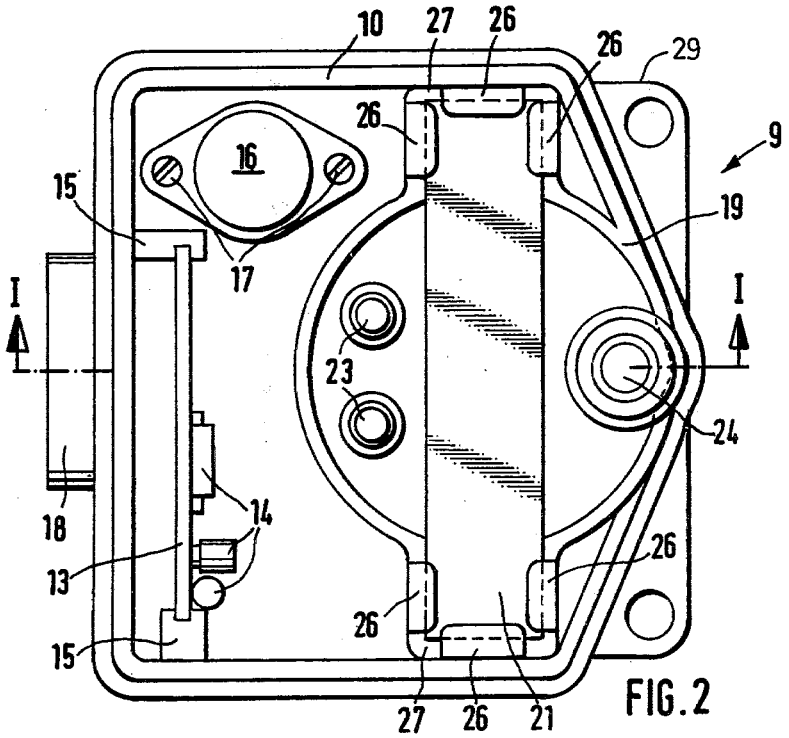

Drawings, illustrating an example:

FIG. 1 is a schematic vertical cross-sectional view through the composite ignition system structure to roughly 1:1 scale on the original patent drawing, taken along line I—I of FIG. 2; and FIG. 2 is a top view of the composite structure, with the cover removed.

A unitary housing 9 (FIGS. 1, 2) is made of metal by investment casting or pressure casting. It is shaped to form, essentially, a trough or tub 10 over which a cover 11 is secured, with a seal 12 interposed. The left portion (FIG. 1) of the trough-like structure has a printed circuit board 13 located therein on which electronic components, schematically illustrated at 14 (FIG. 2) are secured and electrically connected. The printed circuit board 13 is inserted in slots formed in two inwardly projecting holder brackets 15, so that the board 13 can be slid vertically downwardly into the trough-shaped well of the housing. A plug 18, shown only schematically and secured in an opening (not shown) in the trough 10 provides terminal connections to a control cable for current supply to the electronic components on the printed circuit board 13. Power components, for example a switching transistor 16, are secured to the housing structure 10 by screws 17, or the like.

The housing structure 9, and particularly the trough portion 10 thereof, is additionally formed with a separate retainer 19 for the ignition coil 20. The retainer 19 is unitary with the surrounding housing portion 10, that is, the portion 19 for the ignition coil 20 is integral with the entire trough structure 10. The ignition coil itself is shown schematically only; an E-shaped soft iron core 21 has primary and secondary windings secured thereto, both embedded or surrounded by a casting compound 22. The primary terminals 23 and the secondary terminal 24 are located on top of the coil 20 and extend into the space beneath the cover 11 or, in the case of terminal 24, through the cover 11, sealed by a sealing ring to prevent ingress of moisture into the structure. A similar sealing arrangement can be provided with respect to the connector 18, shown at the left side of FIG. 1. A cushioning or compensating mass 25 covers all metallic portions, such as the housing 19 and the soft iron core 21. Mass 25 is provided to compensate for differential expansion under heating conditions, that is, to equalize and distribute stresses arising to differential temperature expansion. This compound 25 functions as a separating and cushioning element while providing for heat transfer.

Three tabs 26 extend inwardly from two diametrically opposite projections 27 formed on the housing 19. Before assembly, the tabs are vertically aligned, thus permitting introduction of the core of the coil into the guide way defined by the tabs and the projections 27. After introduction of the core, the tabs are bent over to secure the position of the ignition coil 20, that is, to secure the core in position, thereby additionally securing the remainder of the portions of the coil, such as the coil elements. Each one of the tabs 26 is bent over the edge of the core 21 to ensure locating the coil as desired and preventing accidental dislodgment even under severe vibration and temperature stress conditions.

The substance 25 which separates and forms a cushion between the metal portions 19, 10 of the housing structure can be relatively thin.

A suitable material for the substance or mass 25 is: a slicon-base material. A suitable thickness for the mass 25 is: 0.4 mm . . . 1.5 mm.

The housing structure can readily be made to be shaped, integrally, with connecting lugs 29 and cast during casting of the well-like structure 10, so that a simple attachment of the entire structure can be ensured, providing good contact to an underlying metallic structure for heat dissipation. The overall surface of the housing structure 10 with the cover 11, as can readily be seen, is substantially greater than the surface of the portion inside the housing which surrounds the ignition coil 20. Thus, excellent heat dissipation of heat generated by the coil is ensured, while additionally providing for protection of circuit components and close association of the circuit components with the coil.

Various changes and modifications may be made within the scope of the inventive concept.

I claim:

1. Composite electronic ignition system structure comprising a housing (9, 19) having walls defining a well or trough tub-like structure (10);

means (15) retaining a circuit structure and at least one electronic control component (14, 16) secured in said housing;

an ignition coil structure (20, 21) located in said housing well adjacent the circuit structure (13) and said at least one control component (16), at least some of the housing walls adjacent said coils being of metal;

a cured resin potting compound (22) surrounding at least a major portion of said ignition coil structure;

and further including a cushioning substance (25) located between the potting compound and the metal walls of said housing adjacent the potting compound, said cushioning substances (25) compensating for temperature and shrinkage stresses.

2. Structure according to claim 1, wherein the unitary housing comprises a unitary pressure or investment casting.

3. Structure according to claim 1, wherein said cushioning substance is a separating substance, separating the potting compound and the adjacent wall portions of the housing.

4. Structure according to claim 1, wherein said cushioning substance is a resilient shock-absorbing pillow structure located between the coil and the wall portions of the housing.

5. Structure according to claim 1, wherein the ignition coil has an iron core structure (21);

and means are provided clamping the iron core structure within the well or trough-like structure (10) of the housing.

6. Structure according to claim 5, wherein the clamping means comprise projecting tabs and bent over and securing the iron core (21) is predetermined position within the well or trough-like structure (10).

7. Structure according to claim 1, wherein the cushioning substance (25) comprises a layer of a separating substance and forming a resilient, shock-absorbing pillow structure located between the metal walls of the housing well or trough-like structure (10) and the potting compound (22) surrounding the coil to prevent adhesion of the potting compound to the adjacent walls of the housing and to provide for shrinkage and temperature compensation and to entirely fill the space between the coil and the housing, even under conditions of differential temperature expansion or shrinkage.

8. Structure according to claim 7, wherein the housing comprises a unitary metal investment or pressure casting.

* * * * *